United States Patent [19]

Peveto

[11] Patent Number: 4,886,467

[45] Date of Patent: Dec. 12, 1989

[54] QUICK CHANGE TOOL HOLDER

[75] Inventor: Johnnie E. Peveto, El Paso, Tex.

[73] Assignee: Chrysler Motors Corporation, Highland Park, Mich.

[21] Appl. No.: 360,677

[22] Filed: Jun. 2, 1989

[51] Int. Cl.[4] ..... H01R 4/64

[52] U.S. Cl. ..... 439/192; 901/41

[58] Field of Search ..... 439/190, 191, 192, 194, 439/271, 132, 158, 198; 279/20, 76; 29/26 A; 414/730, 735; 901/27, 29, 30, 41; 285/18, 137.1, 317

[56] References Cited

U.S. PATENT DOCUMENTS 2,631,185 7/1950 Earle et al. ..... 439/191

FOREIGN PATENT DOCUMENTS 0122565 10/1984 European Pat. Off. ..... 439/198

OTHER PUBLICATIONS

"Tool Changer for Robotic Assembly"; Bothun et al., IBM Tech Discl. Bull., vol. 24, No. 24, No. 6, Nov. 1981, pp. 2745-2746.

*Primary Examiner*—Eugene F. Desmond
*Assistant Examiner*—Walter G. Hanchuk
*Attorney, Agent, or Firm*—Kenneth H. MacLean, Jr.

[57] ABSTRACT

A support device for a tool or fixture which uses pressurized fluid or electricity for power including two base assemblies adapted to be attached together in a manner permitting ready attachment and detachment and with each base having a metallic conduit extending therethrough but insulated therefrom, and with aligned open end portions adapted to engage one another when the bases are attached together thereby providing fluid and electrical power to the tool or fixture through the two base assemblies.

10 Claims, 1 Drawing Sheet

FIG. 1
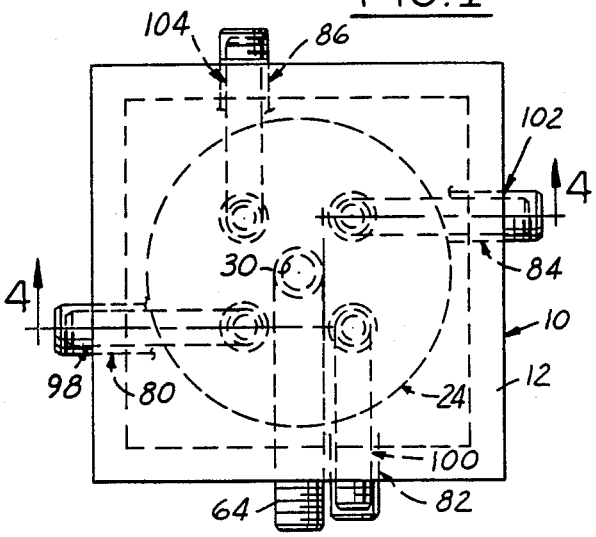
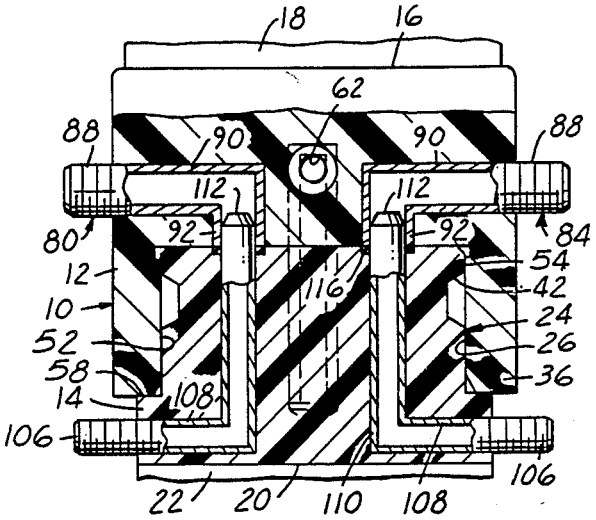
FIG. 4
FIG. 2
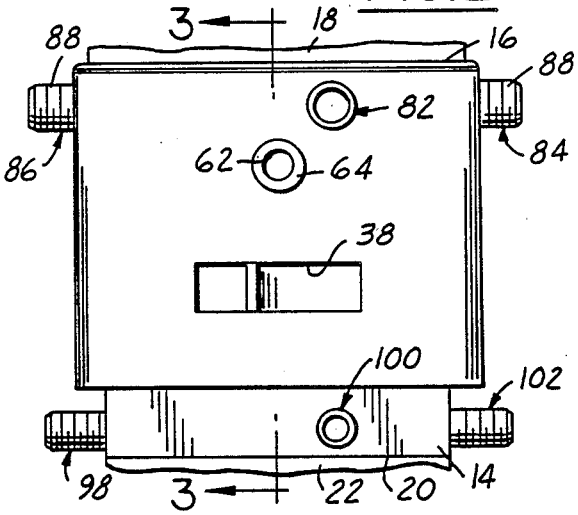
FIG. 5
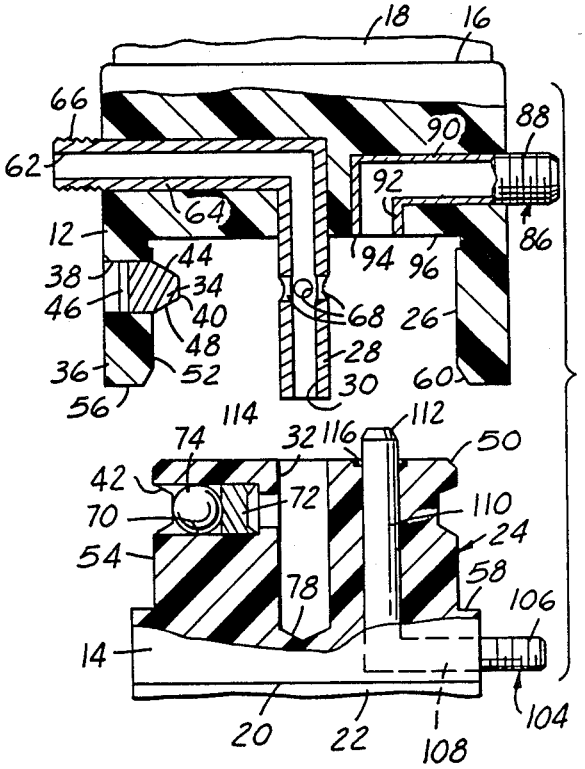
FIG. 3
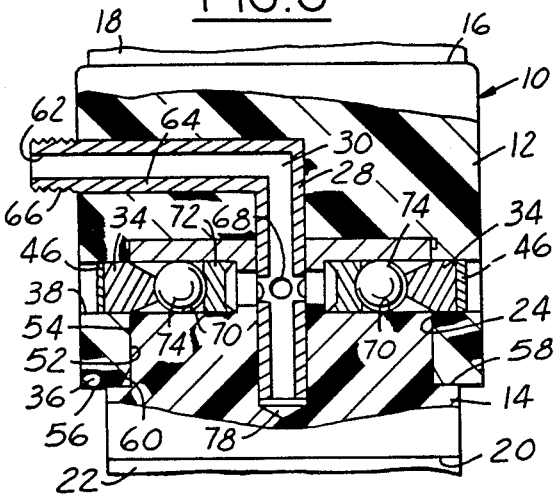

QUICK CHANGE TOOL HOLDER

BACKGROUND OF THE INVENTION

1. Field of the Invention

This application concerns a mount or holder for tools or fixtures which are generally referred to as end effectors. In manufacturing, the desirability of providing a tool holder or the like with the capability to quickly change tooling or replace fixtures on machines is generally recognized. This is so partly because tooling wears as work progresses. Also, the ability to quickly change tools or other end effectors on a machine provides a high degree of flexibility which normally contributes to greater productivity.

2. Description of the Prior Art

There are several different earlier embodiments of tool and fixture mounting devices. Some of these devices are capable of being rapidly detached for quick tool changes. However, these devices are typically quite complicated, bulky, heavy and costly. For some uses, the complicated and heavy tool holder is not a significant detriment. However, for use of the tool or fixture holder on the arm of a robot or the like, it is usually necessary that the tool holder be compact, lightweight and relatively uncomplicated.

With a detachable tool holder of this type, it is usually necessary to provide pressurized air and/or electrical leads from the support structure to the tool or fixture. So that the quick detachability feature of the tool holder is not defeated, it is also necessary to provide quickly detachable connections for the electric power and air. Preferably, these connections are coordinated with the support structure.

SUMMARY OF THE INVENTION

This application concerns an improved quick change tool holder which is particularly well adapted for use on a robot arm. Industrial robots are commonly used in manufacturing today because they perform tasks rapidly an accurately. They can be easily programmed to perform multiple and/or consecutive tasks. This usually requires tools and/or fixture changes. Therefore, it is desirable to provide a means to quickly change tools and/or fixtures as well as the electrical/air leads thereto.

The subject tool holder includes two basic component assemblies. The first component assembly is adapted to be attached to a machine or a robot arm. The second component assembly is adapted to be attached to a tool, fixture or other end effector. These end effectors typically use pressurized air or electricity to function. One of the two component assemblies is configured with a central boss portion having a circumferential groove formed therein. The other of the component assemblies has a recess formed therein adapted to accept the central boss of the other assembly. At least one lock bar is pivotally mounted so as to engage the groove in the boss portion. This secures the two component assemblies together. The lock bar pivots so that the it can move out of the groove to allow separation of the two component assemblies.

The device as defined and described so far provides for an easy and rapid detachment or separation of the two basic component assemblies. However for efficient use of this detachable tool holder, the pressurized air-/electrical supply leads and connections must also be easily and quickly detachable. In this preferred embodiment, the air/electrical connection and detachment occurs simultaneously and in coordination with the detachment of the two components. Also, the air/electrical supply means or leads are common to one another.

Therefore, one important and advantageous feature of the design of the subject quick change tool holder is the provision for quick and easy connection and detachment of the power supply leads for the end effector itself. In the two detachable component assemblies, each has air/electrical supply means for the end effector and there is a quick detachment structure therebetween.

Another important feature of the invention is the provision of common structure for pressurized air and the electrical power through the device.

Other advantageous features of the subject tool holder will be more readily apparent after an examination of the drawings of a preferred example and a reading of the detailed description of the embodiment which follows.

IN THE DRAWINGS

FIG. 1 is a top plane view of the end effector holder assembly; and

FIG. 2 is a elevational view of the end effector holder assembly; and

FIG. 3 is an elevational and sectioned view of the assembly taken-along section line 3—3 in FIG. 2 and looking in the direction of the arrows; and FIG. 4 is an elevational and sectioned view of the assembly taken along section line 4—4 in FIG. 1 an looking in the direction of the arrows; and FIG. 5 is an elevational, sectioned and exploded view of the tool holder which shows how the components and power supply leads cooperate together.

DETAILED DESCRIPTION OF THE INVENTION

In the drawings, a detachable assembly 10 for tools or other end effectors is shown. The assembly 10 consists of two basic parts, an upper component assembly 12 and a lower component assembly 14. In FIGS. 1-4, the component assemblies 12 and 14 are attached together as in use. In FIG. 5, the component assemblies 12 and 14 are separated. The body portions of the two assemblies 12 and 14 are formed of tough elastomeric polymer material. Resultantly, the tool holder is lightweight and a nonconductor. The upper component assembly 12 defines a flat surface 16 against which a spindle portion 18 of a robot arm is attached. Although the attachment means is not shown, in a preferred embodiment it would include threaded fasteners. The other component assembly 14 also defines a flat surface 20 to which a tool or fixture 22 is attached. The attachment means is not shown but would preferably include threaded fasteners.

The component assembly 14 includes a centrally positioned boss portion 24, best shown in FIG. 5. The component assembly 12 has a central recess 26, best shown in FIG. 5. When the component assemblies 12 and 14 are in the attached mode, the boss portion 24 is within the recess 26 as is shown in FIG. 2.

Referring again to FIG. 5, the component assembly 12 also has a depending tubular member 28 which defines a central air passage 30. The other component assembly 14 includes a circular bore 32 adapted to receive the tubular member 28 when the component assemblies 12 and 14 are in the attached mode. The specific function of tubular member 28 and passage 30 in association with the recess 32, will be discussed hereinafter.

As best shown in FIGS. 3 and 5, the component assembly 12 supports a plurality of lock bars 34 adjacent its lower portion or end 36. Lock bars 34 are located between a upper main body of assembly 12 and the lower end portion 36. Each lock bar 34 is pivotally supported or mounted at one end adjacent the corner of the upper component 12 so that the remainder of the lock bar moves in the radial direction relative to the central boss 24 of the lower component 14. To accommodate radial outward movement of the free end portions and midportions of the lock bars 34, an opening or window 38 is provided in each of the four sides of the upper component assembly 12. For a more detailed explanation of the structure relating to the lock bars, reference is made to the copending U.S. application by the subject applicant identified as Ser. No. 07/322,869 entitled "Quick Change Tool Holder", filed on Mar. 14, 1989.

Referring to FIG. 5, each lock bar 34 has a radially inward edge portion 40. The central boss portion 24 of component assembly 14 has a circumferentially extending groove or channel 42 formed therein. The shape of the inner edge portion 40 corresponds to the configuration of the groove or channel 42. As best shown in FIG. 3, edge portion 40 extends into the groove or channel 42. Specifically, a surface 44 of edge portion 40 engages a corresponding upper surface of groove 42 to secure component assemblies 12 and 14 together.

Each lock bar 34 is normally biased radially inward in the lock position shown in FIG. 3 by the action of a leaf-type springs 46. Reference is again made to the above identified copending application for a more detailed illustration and explanation of the lock bar and its spring 46. Basically, one end of the leaf spring 46 is attached to the lock bar 34 adjacent where the lock bar is pivotally mounted to the component assembly 12.

The remainder of the spring 46 extends into engagement with the free end of an adjacent lock bar. As the adjacent lock bar is pivoted radially outward, the free portion of the spring 46 is bent thus generating a return force on the adjacent lock bar tending to pivot it radially inward. The aforedescribed outward pivotal movements of the lock bars 34 places their edge portions 40 out of the channel 42. During a connecting mode between component assemblies 12 and 14, an inclined annularly shaped lower surface 48 of edge portion 40 is engaged by a rounded edge portion 50 of the boss 24. This engagement pivots the lock bars 34 radially outward. Thereby, the boss 24 can be inserted into recess 26 and past the lock bars.

With reference to FIGS. 3, 4 and 5, the component assemblies 12 and 14 snugly engage one another when attached together. This is facilitated by the surface 52 of the upper component assembly 12 which smoothly engages the outer surface 54 of the boss 24. When the boss 24 is fully inserted into recess 26, the lower surface 56 of the upper component assembly 12 seats adjacent the shoulder surface 58 of the lower component assembly 14. During the above described insertion of the boss 24 into recess 26, an inclined surface 60 (see FIG. 5) of the upper component assembly 12 guides the boss into the recess 26.

As previously stated, component assembly 12 includes a tubular pressurized air inlet member 28 having central passage 30. Pressurized air is selectively introduced into passage 30 through a connected air inlet passage 62. A tubular member 64 forms the passage 62 and has an exterior threaded end 66 for attachment to an air pressure hose (not shown).

The air inlet member 28 also has a plurality of radially extending passages 68 which are positioned so that they align with cylinder bores 70 in boss 24 as best seen in FIG. 3. Each bore 70 has a reciprocal piston 72 mounted therein. In addition, each bore 70 supports a spherical ball or actuator member 74. When the assemblies 12 and 14 are in the attached mode, the piston 72 and ball 74 are positioned radially inwardly as shown in FIGS. 3 and 5.

When it is desired to detach the component assemblies 12 and 14, pressurized air is supplied through passages 62, 30, and 68 into bores 70 and thus adjacent the inward ends of pistons 72. This produces an outward force on the pistons 72 and balls 74 which moves the lock bars radially outward. In this unlock position, the lower component assembly 14 is free to move away from the upper component assembly 12. To facilitate the aforedescribed detachment of components assemblies 12 and 14, the lower end of air inlet member 28 is open so that air pressure is applied to the bottom space 78 of the bore 32 (see FIGS. 3 and 5). This produces a separating force between the component assemblies 12 and 14.

As previously stated, the subject device also has quick connectable and detachable air pressure and electrical supply means for the end effector which is supported by the device. Pressurized air and/or electrical power is routed to the end effector through metallic conduit means or tubes molded within the component assemblies 12 and 14. Referring specifically to FIG. 1, the upper component assembly 12 has four such conduits 80, 82, 84 and 86 molded therein. Referring to FIG. 4, it is seen that conduits 80 and 84 are shown. In FIG. 5, conduit 86 is shown. Each conduit includes a threaded external end 88, a radially extending portion 90 and an axially extending portion 92. The portion 92 defines an open end 94 flush with the upper surface 96 of the recess 26.

The lower component assembly 14 also has four metallic conduits or tubes 98, 100, 102 and 104 molded therein. Each conduit 98-104 corresponds to and with an upper conduit 80-86. Like conduits 80-86, each conduit 98-104 has a threaded external end portion 106, a radially extending portion 108 and an axially extending portion 110. As best shown in FIGS. 4 and 5, the axially extending portion 110 includes an exposed open ended portion 112 projecting above the upper surface 114 of the boss 24. The exposed end portion 112 has an external diameter corresponding to the internal diameter of the corresponding upper conduit in assembly 12 so it can be easily inserted into the open end 94 of the corresponding conduit as the component assemblies 12 and 14 are attached together. An O-ring seal 116 is placed in a small channel which surrounds each of the exposed end portions 112. The O-ring 116 is engaged by the lower end of the corresponding conduit in the upper assembly as shown in FIG. 4. This prevents leakage of pressurized air from the conduit when the assemblies are attached.

Although only a single embodiment of the quick change tool holder has been described and illustrated in detail, it is obvious that variations may be made to the components and still fall within the scope of the following claims which define the invention. Specifically, the upper and lower conduits of the component assemblies could be reversed and the assemblies themselves could be reversed without falling outside the scope of the invention.

I claim:

1. For supporting an end effector which uses pressurized fluid or electricity, a device including two basic component assemblies which are readily attached together for support of the end effector while simultaneously supplying pressurized fluid and electricity to the end effector through the device and which are also readily detached, comprising: a first component assembly of electrically nonconductive material; a second component assembly of electrically nonconductive material adapted to be attached to an end effector; a matching surface on each of the first and the second component assemblies, the two surfaces extending in close overlying relation with respect to one another when the component assemblies are connected; a first metallic conduit extending through the first component assembly and having an external portion for transmitting pressurized fluid and electricity thereto, the first conduit having an end portion opening adjacent the matching surface of the first component assembly; a second metallic conduit extending through the second component assembly and having an external portion for discharging pressurized fluid and electricity therefrom for use by the end effector, the second conduit having an end portion opening adjacent the matching surface of the second component assembly whereby the open end portions are configured to operatively engage one another in good electrical connection and leak resistant fluid connection when the component assemblies are attached to one another.

2. The device set forth in claim 1 in which the interior dimension of one open end portion and the exterior dimension of the other open end portion are so formed to allow close telescoping engagement between the end portions as the component assemblies are attached together whereby the pressurized fluid and electricity are effectively transmitted therebetween.

3. The device set forth in claim 1 in which a component assembly is mold formed from elastomeric plastic material with the conduits mostly imbedded therein.

4. The device set for in claim 3 in which the conduit external portion extends through the side surface of the component assembly.

5. The device set forth in claim 2 including an annular seal of resilient material supported about one conduit end portion and adapted to be captured between a matching surface and the other conduit end portion.

6. An improved support device for an end effector which uses pressurized fluid and electricity for power, the support device having two base assemblies, one adapted to be semi-permanently mounted on a machine arm, the other adapted to be semi-permanently mounted to the end effector thereby making removal between the base assemblies and the machine arm and the end effector difficult, the two base assemblies being of the type with means therebetween including matching and closely overlying surfaces to permit readily attachment and detachment together, the improvement comprising: mold formed base assemblies of nonconductive material; each base assembly having a tubular metallic conduit molded therein with an externally exposed open end portion so that pressurized fluid and electricity can be transmitted to and from the conduits; each conduit also having another end portion opening through the matching surfaces and positioned in aligned relationship with one another when the base assemblies are moved into attached relation; means for providing a good fluid leak resistant and electrical connection between the conduits when the base assemblies are attached.

7. The support device set forth in claim 6 in which the interior dimension of one conduit end portion and the exterior dimension of the other conduit end portion are so configured to allow a close telescoping connection therebetween whereby the pressurized fluid and electricity are effectively transmitted therebetween.

8. The support device set forth in claim 6 in which a base assembly is mold formed from elastomeric plastic material with a conduit mostly imbedded therein.

9. The support device set forth in claim 8 in which the conduit external portion extends through and beyond the side surface of the base assembly.

10. The support device set forth in claim 7 including an annular seal of resilient material supported about one conduit end portion and adapted to be captured between a matching surface and the other conduit end portion.

* * * * *